US012564276B1

(12) United States Patent
Nazarov

(10) Patent No.: US 12,564,276 B1
(45) Date of Patent: Mar. 3, 2026

(54) BABY CARRIER SYSTEM

(71) Applicant: Sukhada Nazarov, Portland, OR (US)

(72) Inventor: Sukhada Nazarov, Portland, OR (US)

( * ) Notice: Subject to any disclaimer, the term of this patent is extended or adjusted under 35 U.S.C. 154(b) by 31 days.

(21) Appl. No.: 18/655,372

(22) Filed: May 6, 2024

Related U.S. Application Data

(60) Provisional application No. 63/464,797, filed on May 8, 2023.

(51) Int. Cl.
*A47D 13/02* (2006.01)

(52) U.S. Cl.
CPC ..... *A47D 13/029* (2022.08); *A47D 13/02* (2013.01)

(58) Field of Classification Search
CPC ..... A47D 13/029; A47D 13/02
See application file for complete search history.

(56) References Cited

U.S. PATENT DOCUMENTS

| | | | | |
|---|---|---|---|---|
| 10,750,879 | B2 * | 8/2020 | Schachtner | A47D 13/025 |
| D1,057,400 | S * | 1/2025 | Nazarov | D3/214 |
| 2004/0045073 | A1 * | 3/2004 | Marquez | A41B 13/00 2/69 |

FOREIGN PATENT DOCUMENTS

| | | | | |
|---|---|---|---|---|
| CN | 101632529 A | * | 1/2010 | A47D 13/025 |

* cited by examiner

*Primary Examiner* — Khaled Annis
(74) *Attorney, Agent, or Firm* — Cochran Legal, LLC,; Colin P. Cochran

(57) ABSTRACT

Exemplary arrangements provide a baby carrier system having an adjustable body panel that includes an adjustable opening, an adjustable inner harness in operative connection with the body panel that includes a pair of adjustable shoulder straps in operative connection with the body panel, a pair of removable and adjustable back straps that extend intermediate of the pair of shoulder straps and the body panel and that are removably engageable with each of the shoulder straps and the body panel, an adjustable waist belt that is in operative connection with the body panel, and a moveable support flap that is in operative connection with the adjustable body panel and that is configured to be manually moved to at least one support position in which the moveable support flap extends at least partially above the body panel. Exemplary arrangements additionally include a plurality of releasably engageable covers for the baby carrier system.

20 Claims, 9 Drawing Sheets

BABY CARRIER SYSTEM

1. CROSS REFERENCE TO RELATED APPLICATIONS

This application claims the benefit of U.S. Provisional Application No. 63/464,797, filed May 8, 2023.

2. FIELD OF THE INVENTION

Exemplary arrangements relate to baby carrier systems, baby carrier apparatuses, harness systems for carrying a baby, an interchangeable cover for a baby carrier, and methods of use. Exemplary arrangements also relate to a harness system and interchangeable flap system for carrying a baby, infant, or small child.

3. DESCRIPTION OF RELATED ART

The transportation of babies and toddlers is a well-known task which parents around the globe are familiar. Various baby carriers and/or means of transporting babies and toddlers are known in the art. Baby carriers vary from strollers or buckets on wheels to baby slings and different types of baby "wearing" devices. Different types of these devices have been utilized throughout history by different cultures at different times. Some other forms of baby carrying, commonly known in the art, also include baby carriages, infant car seats, bassinets, portable bassinets, strollers, slings, backpacks, baskets, and bicycle carriers.

Babywearing is also a well-known form of transporting and/or carrying a baby. Babywearing is a term which is used to describe the practice of carrying a baby in a sling, or in the arm of a carrier. Babywearing has been practiced in many different forms for centuries, around the world. To describe babywearing another way, babywearing is a form of baby transport which is often used until a baby is able to walk on their own or until the toddler becomes too big for the carrier to carry the baby. Babywearing is also seen by some as a means of attaching an infant to a parent or guardian. Babywearing is also advantageous because in some forms it frees up both hands of the carrier such that the carrier can engage in other activities, carry other devices, and generally handle the rigors of an infant or toddler.

Some practical examples of babywearing may be baby wearing at the grocery store. In this case, a wearer has both hands or one hand free to shop and engage a shopping cart, while also keeping the shopping cart open for items of purchase. Similarly, the carrier doesn't have to install a cumbersome device on the shopping cart and the like. These and other applications have seen a comeback in the popularity of babywearing as a form of baby carrying in the state of the art.

A baby sling or baby carrier is one form of babywearing known in the art. A baby sling is generally a soft fabric, as compared to a hard or rigorous child car seat. A baby sling usually wraps around the torso or shoulders of the carrier. In this way, a baby sling can often be a comfortable option for both the carrier and the infant. Similarly, baby slings can provide support for the infant and allow the parent and/or carrier to keep hands free for use in other engagements and tasks.

Baby slings have been used in the art for potentially millennia. With little change to baby slings over many years, baby slings, while having their advantages also provide a number of disadvantages. Being made of a soft cloth or fabric, baby slings get dirty quickly. This can be problematic as baby slings are meant for infants which could suffer health risks from a dirty baby sling. Similarly, this is problematic for the carrier.

Furthermore, conventional baby slings and/or other baby carriers are typically a single piece or single fabric. This further makes cleaning and other problems. Cleaning a tiny spot or mess then requires washing the entire fabric or material. Similarly, a single fabric can be difficult to fully install or enable and oftentimes creates a structure for baby carrying which is weak, unsafe, or undesirable.

Thus, there is a long-felt need in the art for a simplified baby carrier system. In particular there is a long-felt need in the art for a simple, easy to use baby carrier which is easy to clean, easy to possess, easy to use, easy to activate and deactivate, friendly and comfortable to a user and infant, easy to wear, flexible, and many other desirables which increase the welfare of the carrier and the infant.

Baby carrier systems, apparatuses, slings, and methods of use may benefit from improvements.

BRIEF SUMMARY OF THE INVENTION

Exemplary arrangements provide a baby carrier system, a baby carrier apparatus, a harness system for carrying a baby, an interchangeable cover for a baby carrier, and methods of use are presented (collectively "baby carrier system"). More specifically, and without limitation, the present disclosure relates to a baby carrier system which improves upon the state of the art. More specifically, and without limitation, the present disclosure relates to a harness system and interchangeable flap system for carrying a baby or small child.

The exemplary arrangements solve a long felt need in the art for a simplified and improved baby carrier system. In particular, among many other aspects of this disclosure, the exemplary arrangements provide a simple, easy to use baby carrier which is easy to clean, easy to possess, easy to use, easy to activate and deactivate, friendly and comfortable to a user and infant, easy to wear, flexible, and many other desirables which increase the welfare of the carrier and the infant, as will become more apparent from the present disclosure.

Exemplary arrangements provide a baby carrier system that may include an adjustable body panel having an outer wall and an inner wall that are in operative connection at respective side and bottom edges thereof to bound an adjustable body panel opening that is configured to receive an infant. The body panel may include an upper portion and a lower portion disposed vertically below the upper portion. The adjustable body panel opening may be manually adjustable to receive infants of varying size. Exemplary arrangements may include an adjustable inner harness that is in operative connection with the body panel. The exemplary harness may include a pair of adjustable shoulder straps that are configured to distribute the weight of the body panel, a pair of removable and adjustable back straps that are in operative connection with a respective one of the pair of adjustable shoulder straps and the body panel, and an adjustable waist belt that is configured to further distribute the weight of the body panel. The exemplary pair of adjustable shoulder straps are in operative connection with the upper portion of the body panel and the adjustable waist belt is in operative connection with the lower portion of the body panel, and each of the pair of adjustable back straps are in operative connection with a portion of the body panel above waist belt. Exemplary arrangements may include a moveable support flap that is in operative connection with the upper portion of the adjustable body panel and that is configured to be changed between a plurality support positions that each provides head and neck support.

In alternative arrangements, the baby carrier system may further include at least one releasably engageable cover that is releasably engageable with the baby carrier system.

In alternative arrangements, each adjustable shoulder strap of the pair of adjustable shoulder straps includes a respective length and a respective shoulder strap length adjuster, the shoulder strap length adjuster is manually manipulable to change the length of the respective adjustable shoulder strap.

In alternative arrangements, the adjustable waist belt includes a circumference and at least one waist belt circumference adjuster, the at least one waist belt circumference adjuster is manually manipulable to change the circumference of the waist belt.

In alternative arrangements, the at least one releasably engageable cover includes at least one aesthetic feature.

In alternative arrangements, the releasably engageable cover is configured to be releasably engageable with the baby carrier system through at least one attachment means.

In alternative arrangements, the at least one attachment means includes at least one first member in operative connection with the baby carrier system and at least one second member in operative connection with the releasably engageable cover, the first and second member comprise one of a plurality of pairs of engageable portions of hook and loop, a plurality of pairs of engageable hooks, a plurality of pairs of engageable magnets, and a plurality of pairs of engageable buttons.

In alternative arrangements, each of the pairs of adjustable shoulder straps includes a plurality of alignment indicia, the plurality of alignment indicia comprise at least a first indicia and a second indicia. The first indicia is disposed on a shoulder strap a first distance from the respective shoulder strap length adjuster and the second indicia is disposed on the shoulder strap a second distance from the respective shoulder strap length adjuster, the second distance is greater than the first distance. When the shoulder strap length has been manually adjusted such that the same indicia on each of the adjustable shoulder straps is disposed from the respective shoulder strap length adjuster the same distance, each of the pair of adjustable shoulder straps has the same length, and when the pair of adjustable shoulder straps have the same length, a weight distribution of the baby carrier system is caused to be equalized between the pair of shoulder straps.

In alternative arrangements, the body panel, adjustable inner harness, and moveable support flap are comprised of sustainable materials.

In alternative arrangements, the moveable support flap is changeable between a first support position and a second support position, in the first support position the moveable support flap extends in overlaying relation with a portion of the body panel, and in the second support position, the moveable support flap extends at least partially above the body panel and the at least one moveable support flap is manually manipulable to a plurality of further support position, each of the plurality of further support positions is intermediate of the first support position and the second support position.

In alternative arrangements, the baby carrier system may further include a pair of adjustable body panel supports, each of the pair of adjustable body panel supports are in operative connection with a respective one of the adjustable shoulder straps and the body panel and extend therebetween, and each of the pair of adjustable body panel supports are configured to be manually manipulable to adjust a length of the respective body panel support.

In alternative arrangements, the baby carrier system may further include a pair of adjustable moveable support flap supports, each of the pair of adjustable moveable support flap supports are in operative connection with a respective one of the adjustable shoulder straps and the body panel and extend therebetween, and each of the pair of adjustable body panel supports are configured to be manually manipulable to adjust a length of the respective moveable support flap support.

Alternative arrangements may provide baby carrier system including an adjustable body panel that includes an adjustable body panel opening configured to receive infants of varying size, an adjustable inner harness that is in operative connection with the body panel and includes a pair of adjustable shoulder straps that are in operative connection with the body panel and that are configured to equally distribute the weight of the body panel, a pair of removable and adjustable back straps that extend intermediate of the pair of shoulder straps and the body panel to provide back support and that are removably engageable with each of the adjustable shoulder straps and the body panel, an adjustable waist belt that is in operative connection with the body panel below the pair of adjustable shoulder straps and that is configured to further equally distribute a weight of the body panel, a moveable support flap that is in operative connection with the adjustable body panel and that is configured to be changed between a plurality of support positions, in which in at least one of the plurality of support positions, the moveable support flap extends at least partially above the body panel.

In alternative arrangements, the baby carrier system may further include at least one releasably engageable cover, the releasably engageable cover is releasably engageable with the body panel.

In alternative arrangements, each adjustable shoulder strap of the pair of adjustable shoulder straps includes a respective length and a respective shoulder strap length adjuster, the shoulder strap length adjuster is configured to change the respective length of each of the adjustable shoulder straps.

In alternative arrangements, each of the pair of adjustable shoulder straps includes a plurality of alignment indicia, the plurality of alignment indicia comprise at least a first indicia, a second indicia, and a third indicia. The first indicia is disposed on a shoulder strap a first distance from the respective shoulder strap length adjuster, the second indicia is disposed on the shoulder strap a second distance from the respective shoulder strap length adjuster, the second distance is greater than the first distance, and the third indicia is disposed on the shoulder strap a third distance from the respective shoulder strap length adjuster, the third distance is greater than the second distance. When the same indicia on each of the adjustable shoulder straps is disposed from the respective shoulder strap length adjuster the same distance, each of the pair of adjustable shoulder straps has the same length, and when the pair of adjustable shoulder straps have the same length, the weight distribution of the baby carrier system is caused to be equalized between the pair of shoulder straps.

In alternative arrangements, the releasably engageable cover is configured to be attached to the baby carrier system through at least one attachment means, the at least one attachment means includes at least one first member in operative connection with the baby carrier system and at least one second member in operative connection with the releasably engageable cover. The first and second member may comprise one of a plurality of pairs of engageable portions of hook and loop, a plurality of pairs of engageable hooks, a plurality of pairs of engageable magnets, and a plurality of pairs of engageable buttons.

In alternative arrangements, the baby carrier system may further include a pair of adjustable body panel supports, each of the pair of adjustable body panel supports are in operative connection with a respective one of the adjustable shoulder straps and the body panel and extend therebetween, and each of the pair of adjustable body panel supports are configured to be manually manipulable to adjust a length of the respective body panel support.

In alternative arrangements, the baby carrier system may further include a pair of adjustable moveable support flap supports, each of the pair of adjustable moveable support flap supports are in operative connection with a respective one of the adjustable shoulder straps and the body panel and extend therebetween, and each of the pair of adjustable body panel supports are configured to be manually manipulable to adjust a length of the respective moveable support flap support.

Alternative embodiments may further provide a baby carrier system, including an adjustable body panel that includes an adjustable body panel opening. The exemplary arrangement may further include an adjustable inner harness that is in operative connection with the body panel and includes a pair of adjustable shoulder straps that are in operative connection with the body panel, a pair of removable and adjustable back straps that extend intermediate of the pair of shoulder straps and the body panel and that are removably engageable with each of the adjustable shoulder straps and the body panel, and an adjustable waist belt that is in operative connection with the body panel. The exemplary arrangements may further include a moveable support flap that is in operative connection with the adjustable body panel and that is configured to be manually moved to at least one support position that extends at least partially above the body panel.

Exemplary arrangements may include a baby carrier system, a baby carrier apparatus, a harness system for carrying a baby, an interchangeable cover for a baby carrier, and methods of use that improve upon the state of the art.

Exemplary arrangements may include an interchangeable cover for a baby carrier.

Exemplary arrangements may include an interchangeable cover for a baby sling.

Exemplary arrangements may include an adjustable, foldable flap for a baby carrier.

Exemplary arrangements may include an internal harness for a baby carrier.

Exemplary arrangements may include a cover or envelope for wrapping a baby carrier.

Exemplary arrangements may include a cover and/or envelope for wrapping a baby carrier.

Exemplary arrangements may include a two-piece assembly for a baby carrier having both an internal harness with a sling and an external changeable cover.

Exemplary arrangements may include a baby carrier with a cover removably attached thereto.

Exemplary arrangements may include a baby carrier with a cover removably attached thereto, the exemplary cover removably connects to the baby carrier by at least one of snaps, friction fit, hook and loop, hooks, fasteners, magnets, magnetic buttons, a combination thereof, or similar.

Exemplary arrangements provide a baby carrier system that is easy to assemble.

Exemplary arrangements provide a baby carrier system that is easily and comfortably worn on the body of the user.

Exemplary arrangements may include increased safety and increased ergonomic benefits for both the wearer and the infant and/or toddler.

Exemplary arrangements may include a foldable flap at the top such that the height of the carrier can be easily adjusted.

Exemplary arrangements may include a foldable flap such that the height of the carrier can be adjusted, making adjustments for the size of the infant and/or making adjustments for the size of the infant over time as the infant grows. In this manner, the exemplary arrangements provide a plurality of attachment points which can be adjusted and/or utilized to achieve different height and size variations throughout the portions of the carrier.

Exemplary arrangements provide a baby carrier system that is easy to clean.

Exemplary arrangements provide a baby carrier system that is structurally sturdy and comfortable.

Exemplary arrangements provide a baby carrier system that is machine washable.

Exemplary arrangements provide a baby carrier system comprised of a two-piece structure.

Exemplary arrangements provide a baby carrier system comprised of a two-piece structure. The exemplary two-piece structure is formed of an inner baby carrier that is separable from the outer cover.

Exemplary arrangements provide a baby carrier system that is easy to use.

Exemplary arrangements provide a baby carrier system that is safe to use.

Exemplary arrangements provide a baby carrier system that is easy to clean.

Exemplary arrangements provide a baby carrier system that is easy to assemble.

Exemplary arrangements provide a baby carrier system that is easy to disassemble.

Exemplary arrangements provide a baby carrier system that is easy to engage with while carrying an infant.

Exemplary arrangements provide a baby carrier system that is easy to disengage while carrying an infant.

Exemplary arrangements provide a baby carrier system that is quick and efficient.

Exemplary arrangements provide a baby carrier system that is robust.

Exemplary arrangements provide a baby carrier system that is comfortable.

Exemplary arrangements provide a baby carrier system that saves time for a user.

Exemplary arrangements may include hands free operation and access for a user.

Exemplary arrangements provide a baby carrier system that is high quality.

These and other objects, features and relationships, and advantages of the present disclosure will become apparent from the specification and claims.

BRIEF DESCRIPTIONS OF THE DRAWINGS

These and/or other aspects of the exemplary arrangements will become apparent and more readily appreciated from the following description of the arrangements, taken in conjunction with the accompanying drawings of which:

DETAILED DESCRIPTION OF THE INVENTION

Figure 1:
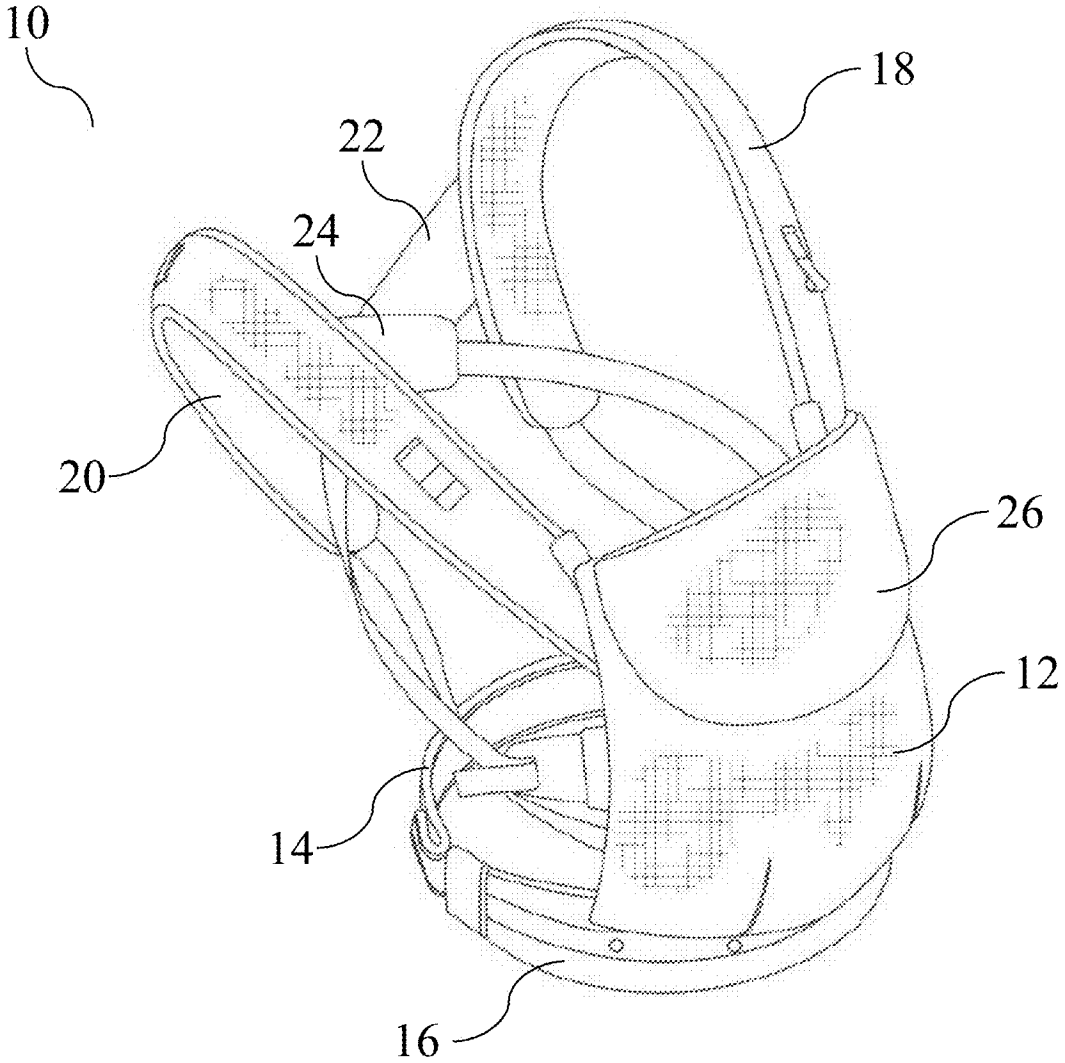
FIG. 1 is an upper front left perspective view of an exemplary arrangement of a baby carrier system.

Reference will now be made in detail to the exemplary arrangements, examples of which are illustrated in the accompanying drawings, wherein like reference numerals refer to the like elements throughout. The exemplary arrangements are described below in order to explain the exemplary arrangements by referring to the figures.

Figure 2:
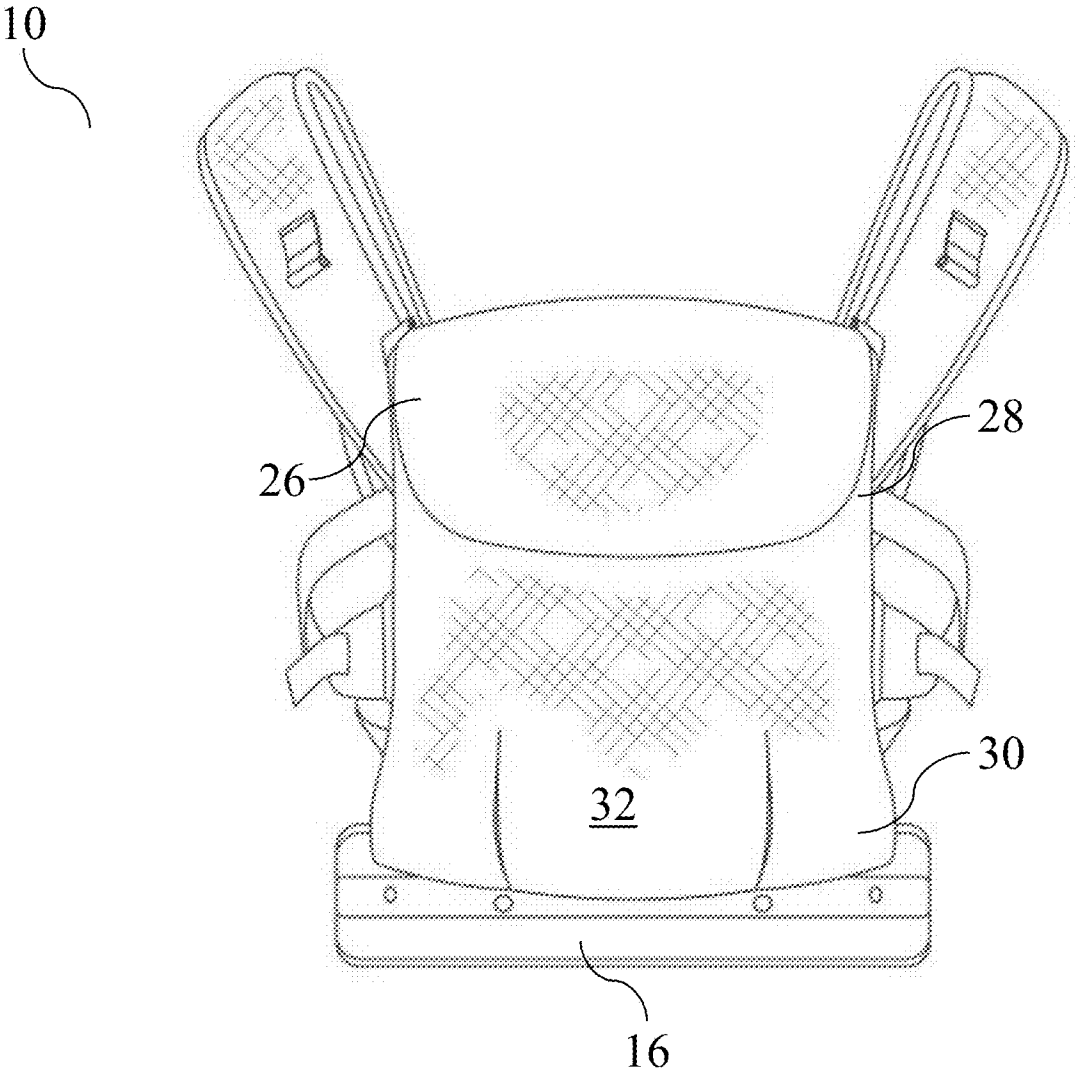
FIG. 2 is a front view of an exemplary arrangement of a baby carrier system.
Figure 3:
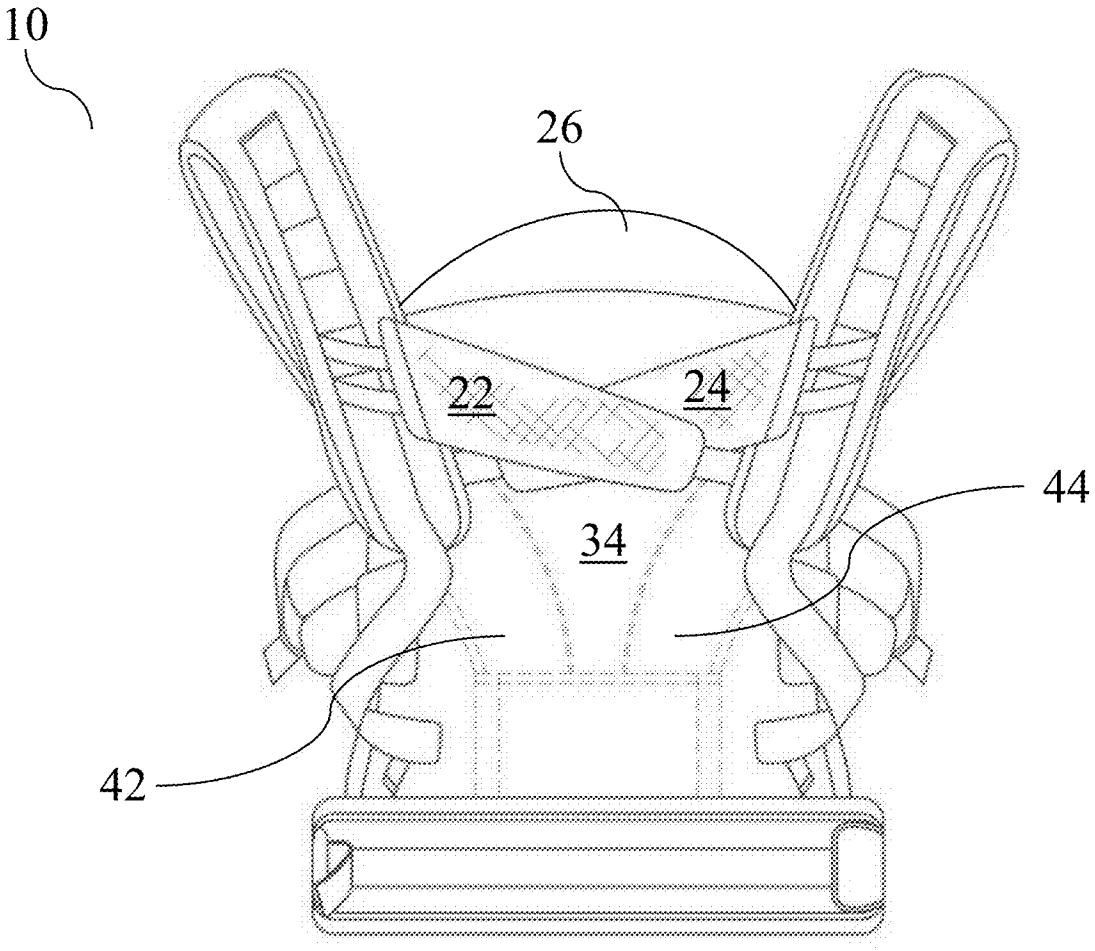
FIG. 3 is a back view of an exemplary arrangement of a baby carrier system.

Referring now to the drawings, and particularly to FIG. 1-3, there is shown therein an exemplary arrangement of a baby carrier system generally indicated 10. The exemplary baby carrier system 10 includes a body panel 12 and an adjustable inner harness 14. The exemplary adjustable inner harness 14 includes a waist belt 16, a pair of adjustable shoulder straps 18 and 20, and a pair of removable and adjustable back support straps 22 and 24. The body panel 12 includes a moveable support flap 26. Of course, it should be understood that this configuration is exemplary, and other arrangements and configurations may be used.

The exemplary body panel 12 is generally rectangular in shape and includes an upper portion 28 and a lower portion 30. However, the body panel 12 may comprise other shapes as well that ergonomically conform to the shape of an infant. The body panel 12 further includes an outer panel wall 32 and an inner panel wall 34. The outer panel wall 32 and the inner panel wall 34 are connected at the left and right or side edges and at the bottom edges of the respective panels to form a body panel opening 36. The body panel opening 36 is configured to receive an infant therein. At least one of the inner panel wall 32 and the outer panel wall 34 includes extremity openings 38, 40, 42, and 44 in which the infant extremities may extend through for comfort, best shown in FIGS. 3 and 9. Extremity openings on the inner wall enable the infant to extend its extremities through the openings when the infant is arranged to be facing the baby carrier system user. Extremity openings on the outer wall enable the infant to extend its extremities through the opening when the infant is arranged to be facing away from the baby carrier system user.

The moveable support flap 26 is in operative connection with the body panel 12. In exemplary arrangements, the flap 26 is connected to the outer panel wall 32 in close proximity to the upper portion 28 of the panel 12. The moveable support flap 26 is configured to be moved between a plurality of support positions to accommodate infants of varying size. As best shown in FIG. 3, the moveable support flap 26 is in an upright support position. In the upright support position, the moveable flap 26 is configured to support the head and necks of the infant position in the opening 36. When the moveable support flap 26 is in one of the plurality of support positions, the flap 26 extends at least partially above the upper portion 28 of the body panel 12. The support flap may be comprised of a resilient material that can me manually manipulated to form to the head or neck of an infant and maintain its position to provide continuous support thereto. Of course, it should be understood that this arrangement is exemplary, and other configurations and arrangements may be used.

Figure 4:
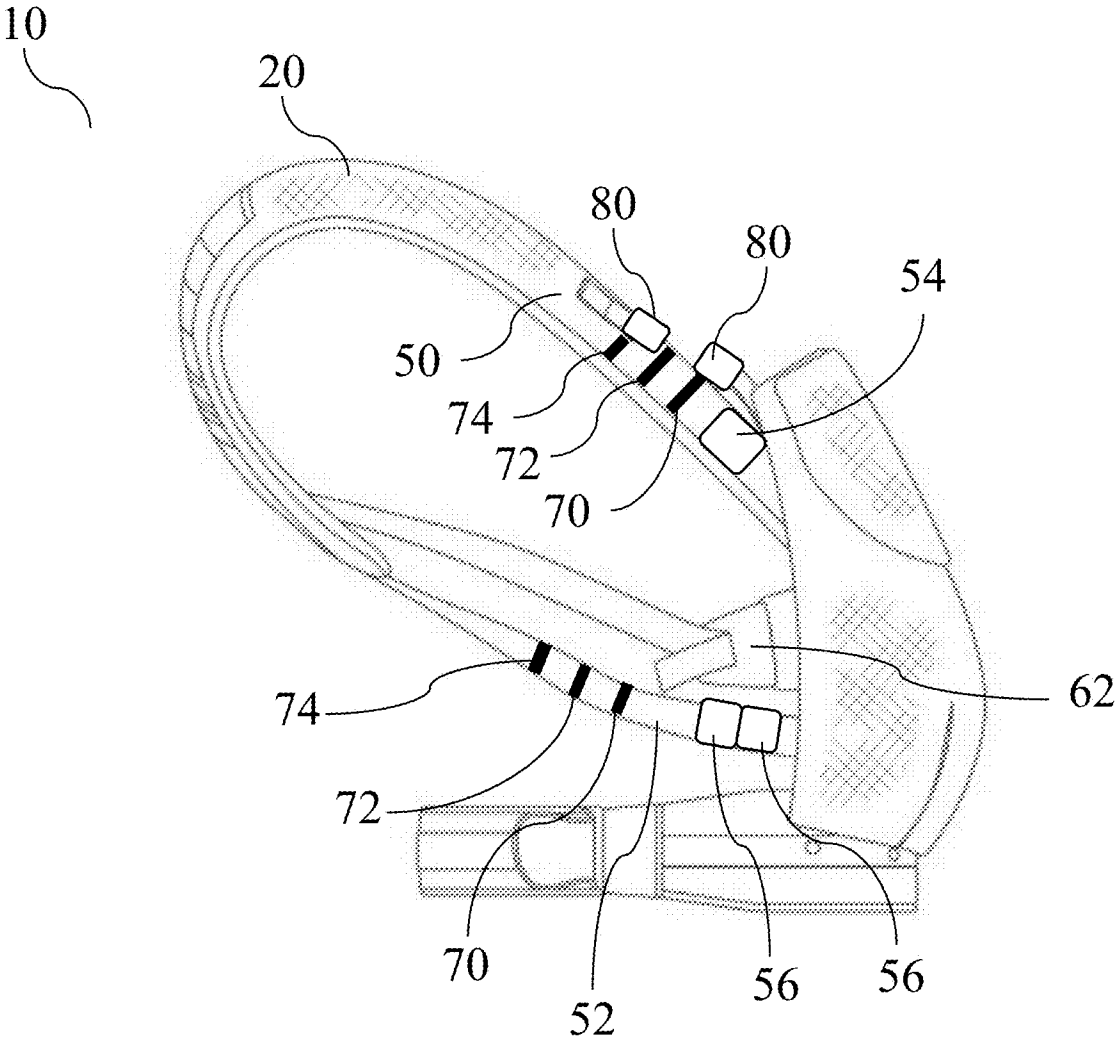
FIG. 4 is a left side view of an exemplary arrangement of a baby carrier system.
Figure 5:
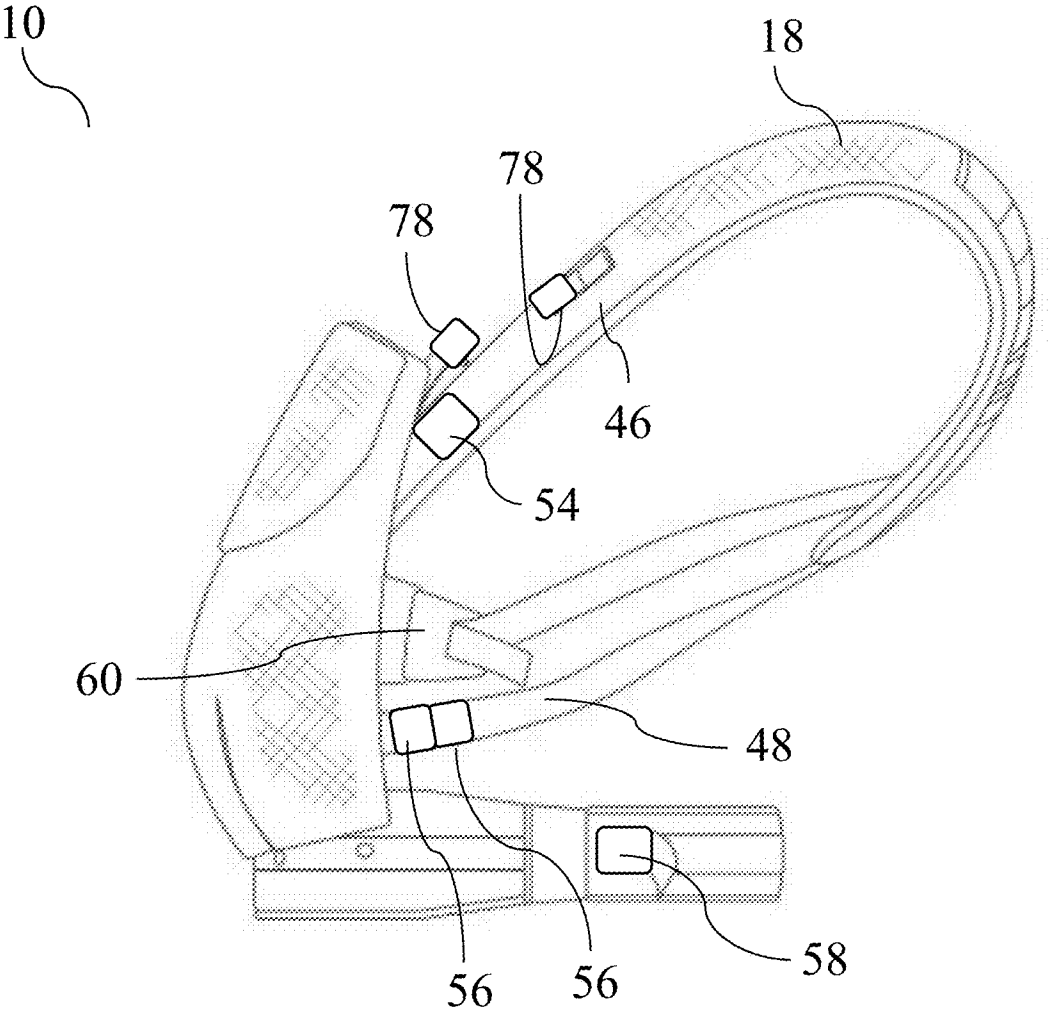
FIG. 5 is a right side view of an exemplary arrangement of a baby carrier system.

Referring now to FIGS. 4 and 5, there is shown therein an exemplary arrangement of a baby carrier system 10. The exemplary adjustable inner harness 14 is comprised of the waist belt 16, the pair of adjustable shoulder straps 18 and 20, and the removable and adjustable back support straps 22 and 24. The exemplary shoulder strap 18 includes an upper strap portion 46 and a lower strap portion 48. The exemplary shoulder strap 20 includes an upper strap portion 50 and a lower strap portion 52. Each of the upper strap portions 46 and 50 include an upper strap length adjuster 54. Each of the lower strap portions include a lower strap length adjuster 56. The exemplary size or length adjustment mechanisms 54 and 56 may comprise any structure or device configured to adjust the length of the shoulder straps 18 and 20 and may comprise a one-piece structure or an engageable or mateable two-piece structure. The waist belt 16 is configured to extend around the waist of a baby carrier system user and includes at least one waist belt circumference adjuster 58 which may comprise any of the adjusters discussed herein. The exemplary strap size or length and waistbelt length or circumference adjustment mechanisms or adjusters may comprise, but is not limited to, a plastic strap adjuster, a metal strap adjuster, a clamp adjuster, a ratchet adjuster, a strap adjuster that slides, engaging sections or strips of hook and loop (Velcro®), an adjustable buckle, a rachet buckle, an anchor buckle, a snap on buckle, a clamp enclosure buckle, a double ring buckle, a roller buckle, a reversible buckle, a screw in buckle, a center bar buckle, or any other device for adjusting the length of a strap or waistbelt. Of course, this arrangement is merely exemplary and other arrangements or configurations may be used.

The exemplary inner harness 14 is in operative connection with the body panel 12. In exemplary arrangements, the upper portions 46 and 50 of the shoulder straps 18 and 20 are in operative connection with the body panel 12 adjacent the upper portion 28 thereof. The lower portions 48 and 52 of the shoulder straps 18 and 20 are in operative connection with the body panel 12 adjacent the lower portion 30 thereof. The waist belt 16 is in operative connection with the lower portion 30 of the body panel 12. In exemplary arrangements, the straps 18 and 20 and the waist belt 16 are in operative connection with the inner panel wall 34 of the body panel 12. However, in other arrangements, the straps 18 and 20 and the waist belt 16 may be in connection with other portions of the body panel 12 such as the edges of the inner panel wall 32 and outer panel wall 34 or the outer panel wall 34. In exemplary arrangements, the shoulder straps 18 and 20 and the waist belt 16 may be permanently or removably connected to the body panel 12 through any attachment means. The attachment means may comprise, but is not limited to, adhesive, sewing, chemical welding, heating welding, adhesive bonding, fusing, molding, laser welding, industrial fabric welding, thermoplastic welding, resistance welding, or any other type of attachment means or joining method. In alternative arrangements in which the straps and waistbelt are releasably engageable with the body panel 12, the attachment means may comprise, a plurality of pairs of engaging snaps, engaging sections or strips of hook and loop (Velcro®), a plurality of pairs of hooks, a plurality of fasteners, a plurality of engaging magnets, a plurality of pairs of magnetic buttons, any of the strap adjustment mechanisms or adjusters discussed herein, or any combination thereof.

The exemplary removable and adjustable shoulder back support straps 22 and 24 are releasably engageable with a respective shoulder strap 18 or 20. The back support straps 22 and 24 comprise a length of strap that extends from the respective shoulder strap 18 or 20 to the body panel 12, and are releasably attached to the body panel 12 intermediate of the upper portion 28 of the body panel 12 and the lower portion 30 of the body panel 12. In certain arrangements, the body panel 12 may include a back support strap receiving portion 60 and 62. The back support receiving portion 60 is designed to provide an attachment means for the back support straps 22 and 24. The exemplary back support straps 22 and 24 may connect to the respective shoulder straps 18 or 20 and the body panel 12 through any of the attachment means or strap adjustment mechanisms or adjusters discussed herein. The exemplary back support straps 22 and 24 are designed to provide additional support to the user while wearing the baby carrier system 10 by further distributing the weight of the baby carrier system 10. Of course, this arrangement is exemplary, and other arrangements and configurations may be used.

Figure 6:
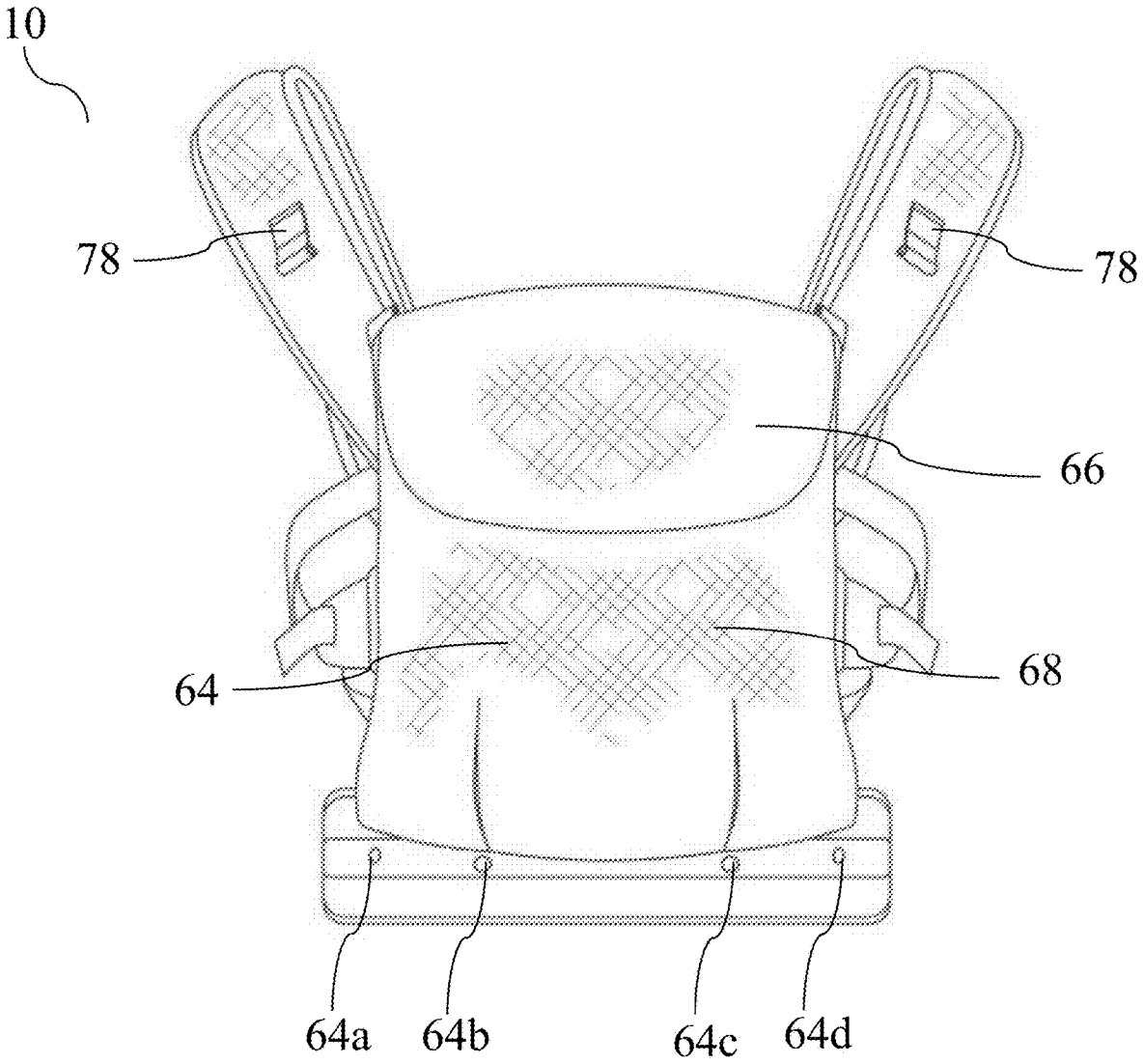
FIG. 6 is front view of an exemplary arrangement of a baby carrier system.

Now referring to FIG. 6, in exemplary arrangements, the baby carrier system 10 further includes a releasably engageable body panel cover 64. In this way, the exemplary baby carrier system 10 comprises a two-piece structure in which the first piece comprises the body panel 12 and the adjustable inner harness 14 (i.e., shoulder straps, waistbelt, and back support straps), and the second piece comprises the releasably engageable body panel cover 64. The exemplary releasably engageable body panel cover 64 is designed to be attached to the baby carrier system 10 and to cover the body panel 12. In exemplary arrangements, the body panel cover, 64 is configured to attach to the waist belt 16 below the lower portion 30 of the body panel 12. The cover 64 extends upward above the upper portion 28 of the body panel 12 and attaches to the inner panel wall 34 of the body panel 12. The cover 64 is designed to overlay the outer panel wall 32 of the body panel 12 in tight or close-fitting relation thereto, so as to avoid becoming snagged on surrounding objects when the user is in motion. In exemplary arrangements, the baby carrier system 10 may include a plurality of releasably engageable covers 64 each having different features and relationships, for example, different aesthetic features or utility. The exemplary cover 64 may be releasably attached to the baby carrier system 10 through any of the attachment means discussed herein. In certain arrangements, the exemplary cover 64 includes a plurality of releasably engageable buttons that releasably engage with buttons 64*a*, 64*b*, 64*c*, and 64*d*. Additional buttons are included on the inner panel wall 34 or on the shoulder straps 18 and 20 to secure the cover 64 to the baby carrier system 10. Of course, this arrangement is exemplary, and other arrangements or configurations may be used.

In certain arrangements, the exemplary cover 64 is designed to extend intermediate of the moveable support flap 26 and the outer panel wall 32. The exemplary cover 64 includes an extension hood 66 that is configured to receive the foldable flap and provide an extension of cover 64 for the foldable support flap 26. The extension hood 66 is designed to move in conjunction with the support flap 26 between the plurality of support positions. The extension hood 66 may be attached to the support flap 26 through any of the attachment means discussed herein, thereby ensuring the extension hood 66 remains in place covering the support flap 26 during movement by the user and during movement through the plurality of support positions. The extension hood 66 may be secured to the support flap 26 through a plurality of releasably engageable buttons in the same manner as cover 64 is secured to the baby carrier system 10.

The exemplary cover 64 may be formed from any material. In exemplary arrangements, the cover 64 and hood 66 is comprised of a sustainable fabric and includes at least one aesthetic feature 68. In alternative arrangements, the cover 64 and hood 66 may be made of elastic material. The aesthetic feature 68 may be a color or combination of colors, a pattern, an embroidering, an animated or cartoon character, a texture, a graphic, text, logos or trademarks, or any combination thereof. The exemplary cover 64 and hood 66 may be comprised of waterproof or water-resistant material, such that the body panel 12 and the infant therein may be protected from environmental precipitation. Of course, this arrangement is exemplary, and other arrangements and configurations may be used.

In exemplary arrangements, the body panel 12 may include alignment features that are designed to guide a user in finding a fit of the baby carrier system 10 that equally distributes the weight of the baby carrier system 10 between the user's shoulders and the user's waist. The exemplary shoulder straps 18 and 20 each include a plurality of alignment indicia 70, 72, and 74. The exemplary alignment indicia 70-74 comprise marking, textures, patterns, or other visible features on the shoulder straps 18 and 20. The alignment indicia 70-74 are included on the shoulder straps 18 and 20 at varying distances from the respective lower shoulder strap adjusters 56. In exemplary arrangements, on each of the shoulder straps 18 and 20, alignment indicia 70 is positioned a first distance from the respective lower shoulder strap adjusters 56, alignment indicia 72 is positioned a second distance from the respective lower shoulder strap adjuster 56 where the second distance is greater than the first distance, and alignment indicia 74 is positioned a third distance from the respective lower shoulder strap adjuster 56 where the third distance is greater than the second distance. The user of the carrier system 10 may adjust the length of the shoulder straps 18 and 20 using the lower shoulder strap adjuster 56 such that same indicia on each of the shoulder straps 18 and 20, for example alignment indicia 70, is immediately adjacent the lower shoulder strap adjuster 56. When the same alignment indicia on each of the shoulder straps 18 and 20 is immediately adjacent the lower shoulder strap adjuster 56, the shoulder strap lengths are approximately identical, or identical. When the shoulder strap lengths are identical or close thereto, the equalization of the weight distribution between the shoulder straps, and thereby the load carried by the user on their shoulders, is optimized. Of course, this arrangement is exemplary, and other arrangements and configurations may be used.

It should be understood that although the alignment indicia are described in connection with the shoulder straps 18 and 20 and the lower shoulder strap adjuster 56, the alignment indicia may be used on the baby carrier system 10 with any of the straps or adjusters to optimize equal weight distribution and the load carried by the user. Further, although only alignment indicia 70-74 have been described, it should be understood that more or less alignment indicia may be used, thereby providing weight and load distribution guidance to users of any size. Still further, it should be understood that this method and arrangement for weight and load distribution may be utilized in combination with any device or object including straps or other support systems.

Referring again to FIGS. 4-6, in exemplary arrangements, body panel 12 further includes a support mechanism 78. The exemplary body panel support mechanism 78 is configured to provide additional support to the body panel 12 as well as an infant received in the body panel opening 36. The exemplary support mechanism includes an adjustable attachment means 80 between the upper portion 28 of the body panel 12 and the upper strap portion 46 of shoulder strap 18 and the upper strap portion 50 of shoulder strap 20. The exemplary adjustable attachment means 80 may comprise any of the attachment means and/or strap adjustment mechanisms or adjusters disclosed herein. The exemplary support mechanism 78 is designed to support the load of an infant received in the body panel 12 by transferring a portion of this load to the shoulder straps 18 and 20 via the adjustable attachment means 80. In this manner, the load of the infant, and the infant itself, is maintained in an upright position and is not fully supported by the outer panel wall 32 of the body panel 12. The infant is prevented from leaning backward too far from the chest or back of the user such that infant may be at risk of tipping backward out of the body panel opening 36. Of course, this arrangement is exemplary, and other arrangements or configurations may be used.

Figure 7:
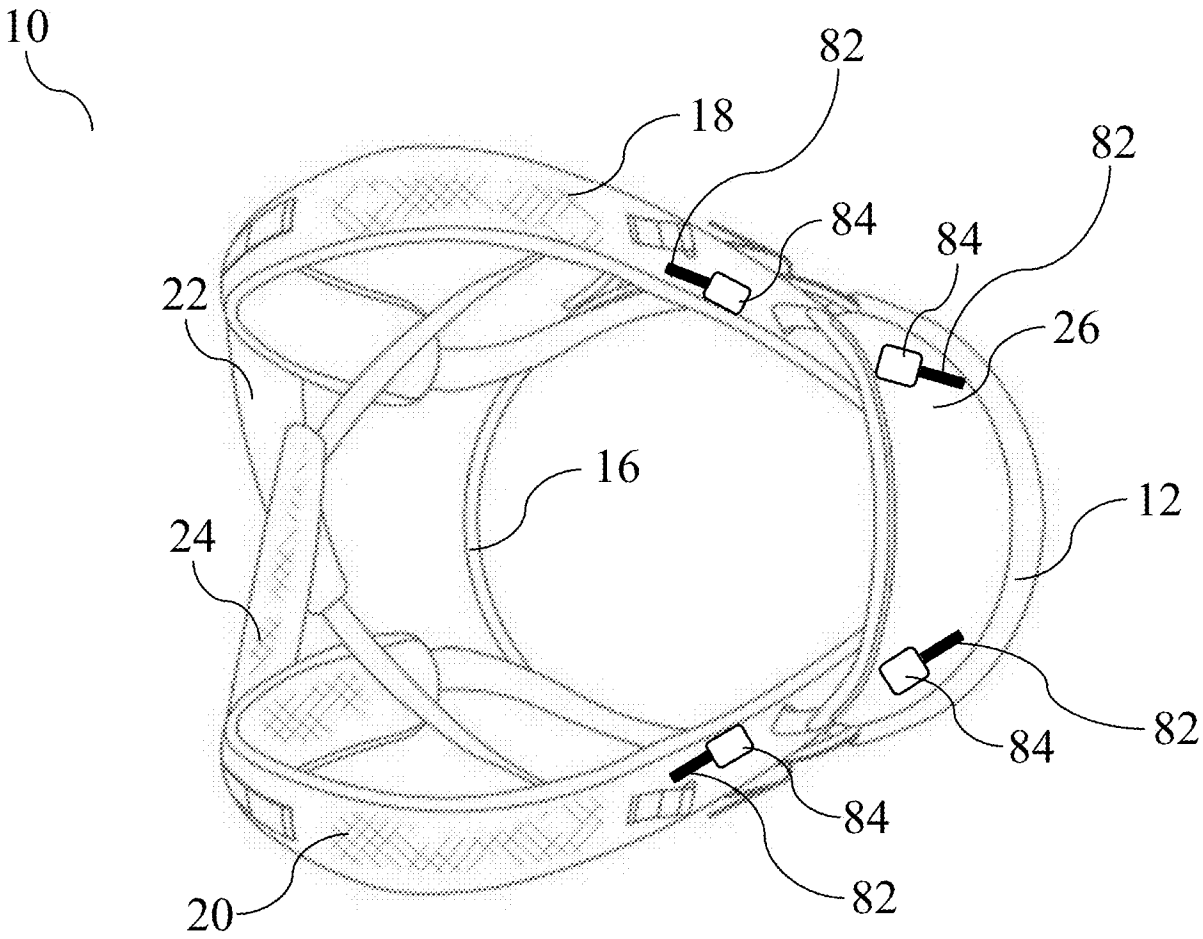
FIG. 7 is a top view of an exemplary arrangement of a baby carrier system.

Now referring to FIG. 7, in exemplary arrangements, the moveable support flap 26 includes a support mechanism 82 similar to the support mechanism 78 that is configured to provide additional load support to the head or neck region of an infant received within the panel opening 36. The exemplary support mechanism 82 comprises an adjustable attachment means 84 that extends and is connectable between the moveable support flap 26 and the shoulder straps 18 and 20. In this manner, when the moveable support flap 26 is positioned in one of the plurality of support positions, the support mechanism 82 provides additional load support to the flap 26 such that the flap 26 is maintained in the intended support position. The exemplary adjustable attachment means 84 may comprise any of the attachments means, adjustment mechanisms or adjusters discussed herein. Of course, this arrangement is exemplary, and other arrangement or arrangements may be used.

Figure 8:
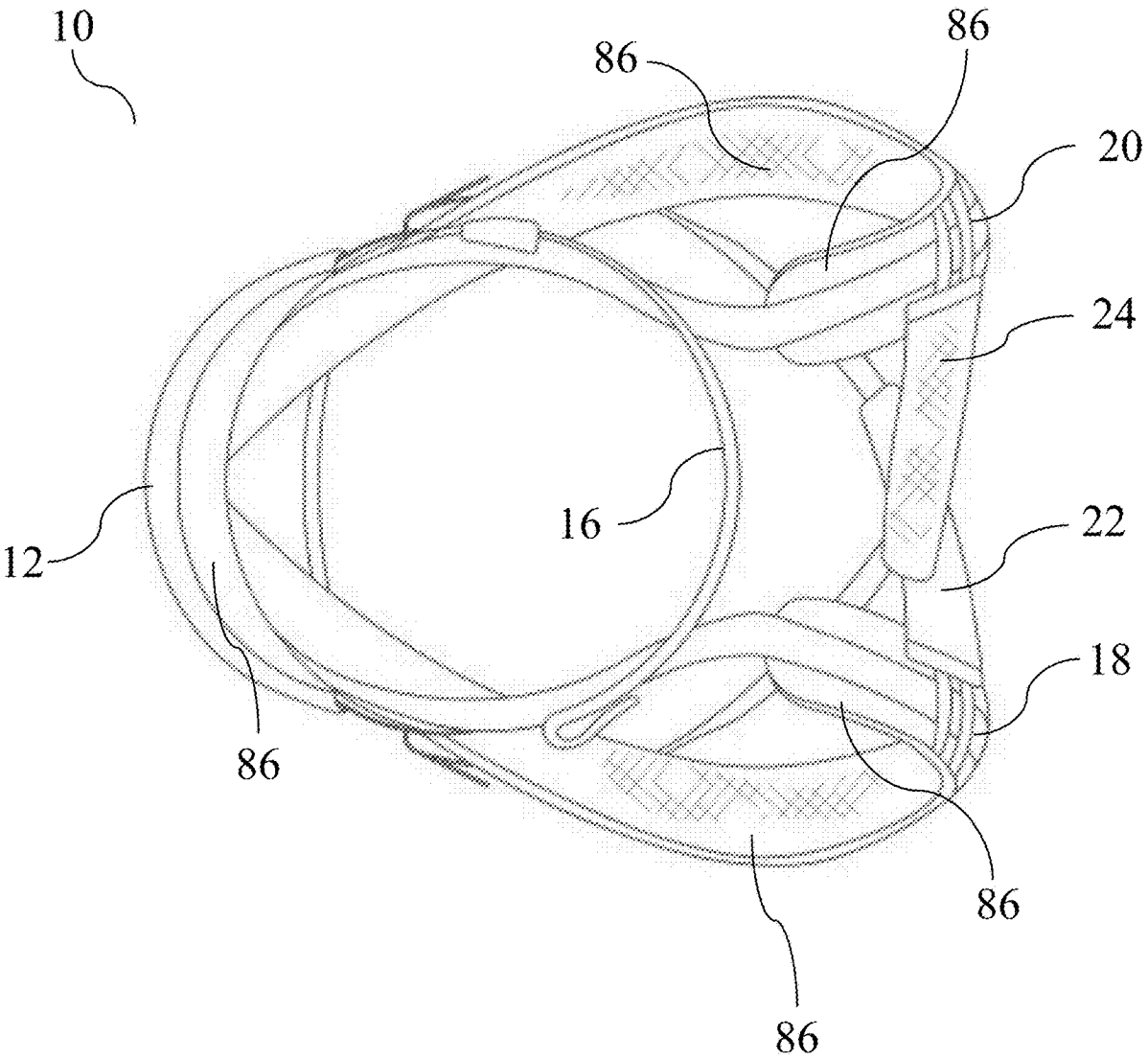
FIG. 8 is a bottom view of an exemplary arrangement of a baby carrier system.
Figure 9:
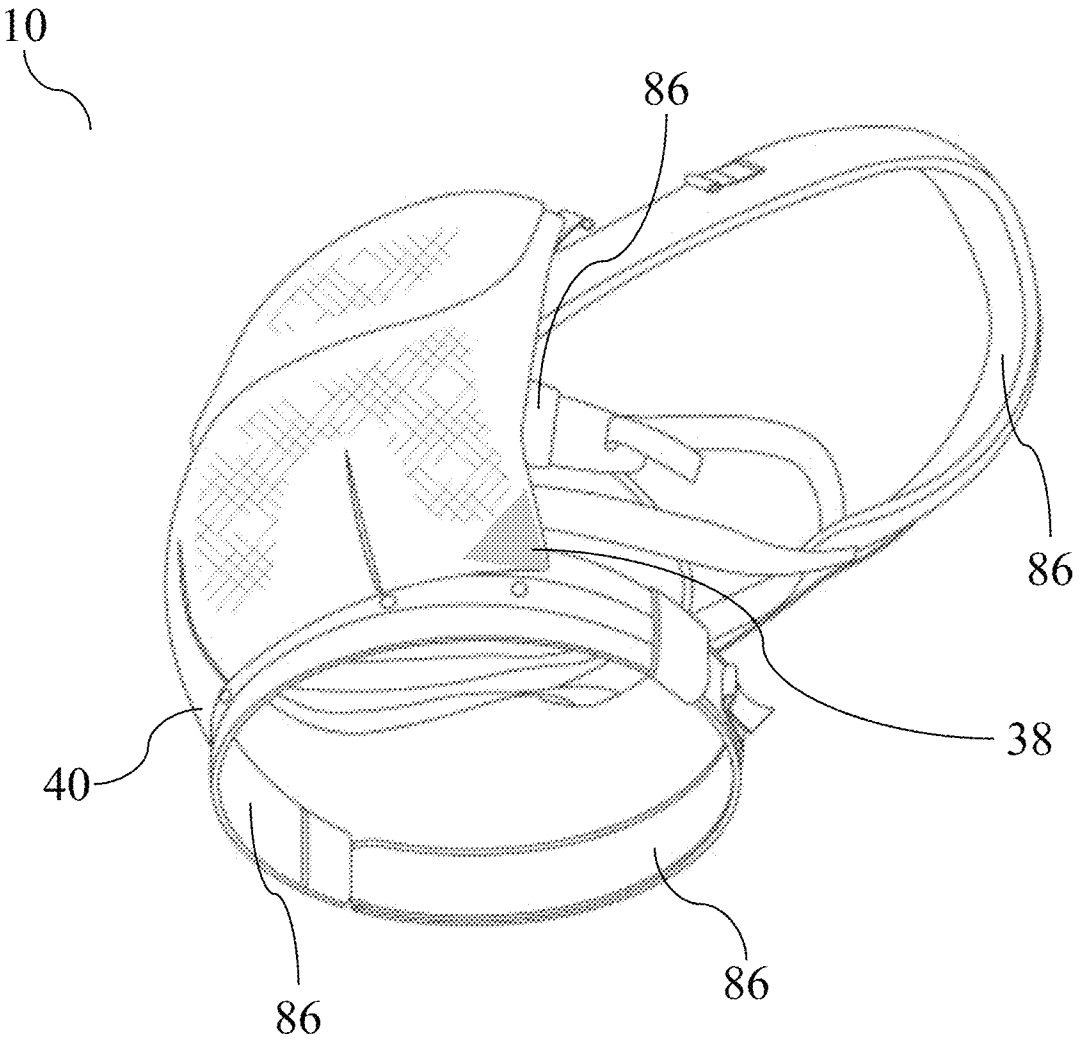
FIG. 9 is a bottom front right perspective view of an exemplary arrangement of a baby carrier system.

Now referring to FIGS. 8-9, in exemplary arrangements, portions of the of the baby carrier system 10 may include padding 86 or other comfort providing features. The padding 86 may comprise foam, air mesh, gel-infused materials, or ethylene vinyl acetate (EVA) foam. The exemplary padding 86 may be included in any portion of the baby carrier system 10, for example, the padding 86 may be included in the portions of the shoulder straps 18 and 20, portions of the waistbelt 16, portions of the back support straps 22 and 24, the moveable support flap 26, the body panel 12 and the interior area thereof. Additionally, the baby carrier system 10 may include cooling features such as mesh to provide airflow to the body panel 12 and between the user and the carrier system 10. Further, the baby carrier system 10 may include insulating features that keep the body panel 12 and the infant therein at a warm, comfortable temperature. Still further, portions of the baby carrier system 10 may include fluid floatation devices such that the baby carrier system acts as a life jacket for the user and may include further floatation elements that maintains the baby carrier system 10 in an upright position by itself with the infant's head above water in the event the carrier system 10 is separated from the user. Of course, these arrangements are exemplary, and other arrangements or configurations may be used.

In exemplary arrangements, the entire baby carrier system 10 or portions thereof may be formed from sustainable materials.

In alternative arrangements, as one example, baby carrier system 10 is formed of a multi structured product which is sturdy, safe, and machine washable. In the exemplary arrangement shown, as one example, baby carrier system 10 is formed of a two-piece structure, such that the inner baby carrier and/or harness structure is removable from an outer cover or cover. The cover can be easily removed and easily attached and detached from the harness structure such that the cover can be washed and cleaned and replaced with a second or third removable cover. Similarly, the different covers can be attached and detached from the harness structure for color and stylistic reasons such as aesthetic appearance.

In alternative arrangements, baby carrier system 10 provides an ability to change appearances over time instead of wearing the same color baby carrier or harness every day. Similarly, owning multiple covers allows a user to wash some covers while other covers are being utilized. Multiple covers are not required. A single outer cover is hereby contemplated for use. However, a user may have multiple covers such as two covers, three covers, four covers, five covers, six covers, seven covers, or more, all of varying sizes, textures, patterns, materials, or even connection, attachment, or fastener means, as may be desired in different applications.

In alternative arrangements, the outer cover is formed of a skin friendly material which provides flexibility for a user. The material is generally formed so as to be durable and may be formed of a synthetic fiber material which creates reliability and durability in carrying of an infant. Similarly, and in another arrangement, the outside cover is made from an all-natural, eco-friendly, or sustainable material. Various material types are hereby contemplated for use and include, but are not limited to, hypo-allergenic materials, materials safe for infant skin, soft materials, durable materials, cloth materials, cotton materials, synthetic materials, or a combination thereof.

In alternative arrangements, baby carrier system 10 is formed of a shape and a plurality of adjustable sizing features which make the system easy to wear. The exemplary baby carrier system 10 is also easy to assemble. The exemplary baby carrier system 10 is formed of an easy, adjustable system which can be adjusted by the user as the device is being worn to make sure the fit is comfortable and at a desired level. Said another way, any adjustment, initial or subsequent, is completed or can be completed after the system is placed on a user which ensures all the straps, etc. are complete and in place so that the baby can be secured easily and comfortably. In alternative arrangements, a plurality of straps, adjustable straps, and/or buckles and/or ergonomic securement features are provided to create a comfortable system which is safe and comfortable for both the wearer and the infant being carried.

In alternative arrangements, the exemplary baby carrier system 10 includes a foldable flap 26. The foldable flap is formed of any suitable size, shape, and design and is configured to provide adjustability in the size of the carrier. The exemplary baby carrier system 10 is capable of providing carrying of infants of all sizes up to toddlers and small children, and children, and even large animals if needed. The exemplary foldable flap 26, is adjustable which controls the length and/or depth of the carrier space. In this way, the flap 26 can be lengthened, easily adjustable on the front of the user at any time, such that a larger infant and/or small child can be accommodated. This is also useful when switching between children of varying sizes which may need switched on walks, in a daycare setting, in families with more than one child, as a baby grows, and the like.

In alternative arrangements, the exemplary baby carrier system 10 is meant to be worn around the shoulders and waist of a user. The user may be any user interacting with or utilizing the system 10. This may include viewing, controlling, analyzing, manipulating, and/or interacting with system 10. The user is not limited to a single user but may be a plurality of users. The user is generally referred to as the carrier. A user may also be the infant being carried. Infant generally refers to a small child ranging from a newborn to many years in age. Infant may also refer to a small animal such as a dog, cat, or the like.

In addition to the above identified features, options, controls, and components, the exemplary baby carrier system 10 may also include other features and functionalities, among other options, controls, and components. In alternative arrangements, the exemplary baby carrier system 10 can be utilized in a plurality of ways. In one example, a wearer will place system 10 onto the wearers body, particularly with shoulder straps 18 and 20 fitting over the user's shoulders. The user will wear the system, formed generally of the harness and/or straps with the sling or body panel 12 holding portion of the system and cover already attached to one another prior to placing on the shoulders and/or over the body of the user.

Once the exemplary baby carrier system 10 is placed on the body of the user, the user will engage with the plurality of buckles or adjusters near the waist and shoulders to tighten to a desired level. The user can also utilize the plurality of strap adjustment mechanisms or adjusters to adjust the length of the straps over the shoulder to fit snugly and comfortably. In this way, the exemplary baby carrier system 10 includes a plurality of buckles for adjusting the shoulder straps, a mesh padding for thigh and torso protection, a plurality of side buckles for adjustment of different torso sizes, a plurality of buckles for adjusting the sling and/or baby carrying portion of system 10, and the like.

Furthermore, once the buckles and/or plurality of straps around the waist are tightened, the shoulder strap can be adjusted based on the wearer's preference and desired wear level. Subsequently the baby and/or infant can be set in the sling or body panel 12 near the chest. Subsequently and if desired, a user can adjust the plurality of buckles and/or straps further so as to adjust the sitting height, distance, location, and snugness of the infant and/or child. Subsequently, a plurality of buckles can be snapped to secure the infant in place for comfort and safety.

In alternative arrangements, the exemplary baby carrier system 10 enables the user to carry an infant and/or baby in a hands-free fashion. While this example shows the user adjusting after placing the harness on the user, the harness can also be adjusted before engaging with the harness. Similarly, this arrangement describes the system being utilized in a front facing fashion. Said another way, this example discusses a carrier wearing the baby on the front or chest side of a user. Alternatively, the exemplary baby carrier system 10 can be utilized such that a baby or infant is worn on the back or rear side of a user and/or sides of a user and/or a combination of these positions as may be desired. The system 10 also provides for adjustments as needed to change the position of the infant even when the infant is being worn. Such as transitioning from wearing on the front to the side and/or back or the like while the infant is being worn so activities can change and/or general comfort can be gained. This further provides advantages because the infant need not be set down or removed from the system in order to make manipulations to the system and/or changes.

In this way, the exemplary baby carrier system 10 is adaptable, safe, comfortable, secure, and easy to use for both a carrier and infant. Furthermore, in this way, system 10 is easy to remove, clean, attach, detach and the like. Furthermore, and in this way, system 10 is adjustable as the baby grows or as different infants are worn such that the flap can accommodate varying lengths and sizes, the flap being a length which is adjustable. In this way, system 10 provides a two-part design including a removable cover, safe harness, folded flaps and the like while providing soft and natural fiber and material options which can be interchangeable depending on the needs of the carrier and infant.

Thus, the exemplary arrangements of the baby carrier system described herein achieve improved operation, eliminate difficulties, encountered in the use of prior devices and systems, and obtain the useful results described herein.

Further, it should be understood that the features and/or relationships associated with one of the exemplary arrangements described may be combined with features and/or relationships from another exemplary arrangement. That is, various features, and/or relationships from various arrangements can be combined to produce further arrangements. The inventive scope of this disclosure is not limited only to the exact arrangements that have been shown and/or described herein.

In the foregoing description, certain terms have been used for brevity, clarity and understanding. However, no unnecessary limitations are to be implied there from because such terms are used for descriptive purposes and are intended to be broadly construed. Moreover, the descriptions and illustrations herein are by way of examples, and the new and useful features are not limited to the exact features shown and described.

Having describe the features, discoveries, and principles of the exemplary arrangements, the manner in which they are constructed and operated, and the advantages and useful results attained, the new, and you spell structures, devices, elements, arrangements, parts, combinations, systems, equipment, operations, methods, processes and relationships are set forth in the appended claims.

I claim:

1. A baby carrier system, comprising:

an adjustable body panel, wherein the adjustable body panel includes an outer wall and an inner wall, wherein the outer wall and the inner wall are in operative connection at respective side and bottom edges thereof to bound an adjustable body panel opening, wherein the body panel opening is configured to receive an infant, and wherein the body panel includes an upper portion and a lower portion disposed vertically below the upper portion, and wherein the adjustable body panel opening is manually adjustable to receive infants of varying size, an adjustable inner harness, wherein the adjustable inner harness is in operative connection with the body panel and includes a pair of adjustable shoulder straps, wherein the pair of adjustable shoulder straps are configured to distribute the weight of the body panel, a pair of removable and adjustable back straps, wherein each of the pair of removable and adjustable back straps are in operative connection with a respective one of the pair of adjustable shoulder straps and the body panel, an adjustable waist belt, wherein the waist belt is configured to further distribute the weight of the body panel, wherein the pair of adjustable shoulder straps are in operative connection with the upper portion of the body panel and the adjustable waistbelt is in operative connection with the lower portion of the body panel, and wherein each of the pair of adjustable back straps are in operative connection with a portion of the body panel above waist belt, a moveable support flap, wherein the moveable flap is in operative connection with the upper portion of the adjustable body panel, and wherein the moveable flap is configured to be changed between a plurality support positions, wherein each of the plurality of support positions provides head and neck support.

2. The baby carrier system according to claim 1, further comprising:

at least one releasably engageable cover, wherein the releasably engageable cover is releasably engageable with the baby carrier system.

3. The baby carrier system according to claim 2, wherein each adjustable shoulder strap of the pair of adjustable shoulder straps includes a respective length and a respective shoulder strap length adjuster, wherein the shoulder strap length adjuster is manually manipulable to change the length of the respective adjustable shoulder strap.

4. The baby carrier system according to claim 3, wherein the adjustable waist belt includes a circumference and at least one waist belt circumference adjuster, wherein the at least one waist belt circumference adjuster is manually manipulable to change the circumference of the waist belt.

5. The baby carrier system according to claim 4, wherein the at least one releasably engageable cover includes at least one aesthetic feature, wherein the at least one aesthetic feature comprises at least one of:

a color, a plurality of colors, a pattern, an embroidering, a texture, or a graphic.

6. The baby carrier system according claim 5, wherein the releasably engageable cover is configured to be releasably engageable with the baby carrier system through at least one attachment means.

7. The baby carrier system according to claim 6, wherein the at least one attachment means includes at least one first member in operative connection with the baby carrier system and at least one second member in operative connection with the releasably engageable cover, where the first and second member comprise one of a plurality of pairs of engageable portions of hook and loop, a plurality of pairs of engageable hooks, a plurality of pairs of engageable magnets, and a plurality of pairs of engageable buttons.

8. The baby carrier system according to claim 7, wherein each of the pairs of adjustable shoulder straps includes a plurality of alignment indicia, wherein the plurality of alignment indicia comprise at least a first indicia and a second indicia, wherein the first indicia is disposed on a shoulder strap a first distance from the respective shoulder strap length adjuster, and wherein the second indicia is disposed on the shoulder strap a second distance from the respective shoulder strap length adjuster, wherein the second distance is greater than the first distance, wherein when the shoulder strap length has been manually adjusted such that the same indicia on each of the adjustable shoulder straps is disposed from the respective shoulder strap length adjuster the same distance, each of the pair of adjustable shoulder straps has the same length, and wherein when the pair of adjustable shoulder straps have the same length, a weight distribution of the baby carrier system is caused to be equalized between the pair of shoulder straps.

9. The baby carrier system according to claim 8, wherein the body panel, adjustable inner harness, and moveable support flap are comprised of sustainable materials.

10. The baby carrier system according to claim 9, wherein the moveable support flap is changeable between a first support position and a second support position, wherein in the first support position the moveable support flap extends in overlaying relation with a portion of the body panel, and wherein in the second support position, the moveable support flap extends at least partially above the body panel, and wherein the at least one moveable support flap is manually manipulable to a plurality of further support position, wherein each of the plurality of further support positions is intermediate of the first support position and the second support position.

11. The baby carrier system according to claim 10, further comprising:

a pair of adjustable body panel supports, wherein each of the pair of adjustable body panel supports are in operative connection with a respective one of the adjustable shoulder straps and the body panel and extend therebetween, wherein each of the pair of adjustable body panel supports are configured to be manually manipulable to adjust a length of the respective body panel support.

12. The baby carrier system according to claim 11, further comprising:

a pair of adjustable moveable support flap supports, wherein each of the pair of adjustable moveable support flap supports are in operative connection with a respective one of the adjustable shoulder straps and the support flap and extend therebetween, wherein each of the pair of adjustable moveable support flap supports are configured to be manually manipulable to adjust a length of the respective moveable support flap support.

13. A baby carrier system, comprising:

an adjustable body panel, wherein the body panel includes an adjustable body panel opening, and an adjustable inner harness, wherein the adjustable inner harness is in operative connection with the body panel and includes a pair of adjustable shoulder straps, wherein each of the pair of adjustable shoulder straps are in operative connection with the body panel, a pair of removable and adjustable back straps, wherein the pair of removable and adjustable back straps extend intermediate of the pair of shoulder straps and the body panel, and wherein the pair of removable and adjustable back straps are removably engageable with each of the adjustable shoulder straps and the body panel, an adjustable waist belt, wherein the adjustable waist belt is in operative connection with the body panel, and a moveable support flap, wherein the moveable support flap is in operative connection with the adjustable body panel, and wherein the moveable support flap is configured to be manually moved to at least one support position, wherein in the at least one support position, the moveable support flap extends at least partially above the body panel.

14. The baby carrier system according to claim 13, at least one releasably engageable cover, wherein the releasably engageable cover is releasably engageable with the body panel.

15. The baby carrier system according to claim 14, wherein each adjustable shoulder strap of the pair of adjustable shoulder straps includes a respective length and a respective shoulder strap length adjuster, wherein the shoulder strap length adjuster is configured to change the respective length of each of the adjustable shoulder straps.

16. The baby carrier system according to claim 15, wherein each of the pair of adjustable shoulder straps includes a plurality of alignment indicia, wherein the plurality of alignment indicia comprise at least a first indicia, a second indicia, and a third indicia, wherein the first indicia is disposed on a shoulder strap a first distance from the respective shoulder strap length adjuster, wherein the second indicia is disposed on the shoulder strap a second distance from the respective shoulder strap length adjuster, wherein the second distance is greater than the first distance, and wherein the third indicia is disposed on the shoulder strap a third distance from the respective shoulder strap length adjuster, wherein the third distance is greater than the second distance, wherein when the same indicia on each of the adjustable shoulder straps is disposed from the respective shoulder strap length adjuster the same distance, each of the pair of adjustable shoulder straps has the same length, and wherein when the pair of adjustable shoulder straps have the same length, the weight distribution of the baby carrier system is caused to be equalized between the pair of shoulder straps.

17. The baby carrier system according to claim 16, further comprising:

a pair of adjustable body panel supports, wherein each of the pair of adjustable body panel supports are in operative connection with a respective one of the adjustable shoulder straps and the body panel and extend therebetween, wherein each of the pair of adjustable body panel supports are configured to be manually manipulable to adjust a length of the respective body panel support.

18. The baby carrier system according to claim 17, further comprising:

a pair of adjustable moveable support flap supports, wherein each of the pair of adjustable moveable support flap supports are in operative connection with a respective one of the adjustable shoulder straps and the support flap and extend therebetween, wherein each of the pair of adjustable body panel supports are configured to be manually manipulable to adjust a length of the respective moveable support flap support.

19. The baby carrier system according claim 14, wherein the releasably engageable cover is configured to extend in operative releasable connection with the body panel, the moveable support flap, and at least a portion of each of the pair of adjustable shoulder straps.

20. A baby carrier system, comprising:

a body panel, wherein the body panel includes a body panel opening configured to receive a child therein, and an adjustable inner harness, wherein the adjustable inner harness is in operative connection with the body panel and includes a pair of adjustable shoulder straps, wherein each of the pair of adjustable shoulder straps are in operative connection with the body panel, a pair of adjustable back straps, wherein the pair of adjustable back straps extend intermediate of and in releasable operative connection with the pair of shoulder straps and the body panel, an adjustable waist belt, wherein the adjustable waist belt is in operative connection with the body panel, and a moveable support flap, wherein the moveable support flap is in operative connection with the adjustable body panel, and wherein the moveable support flap is configured to be moved to at least one support position.

* * * * *